US006948332B2

(12) United States Patent
Lee et al.

(10) Patent No.: US 6,948,332 B2
(45) Date of Patent: Sep. 27, 2005

(54) BLOWING FAN AND REFRIGERATOR HAVING THE SAME

(75) Inventors: Dong Il Lee, Seoul (KR); Hyoun Jeong Shin, Incheon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/758,105

(22) Filed: Jan. 16, 2004

(65) Prior Publication Data

US 2005/0115267 A1 Jun. 2, 2005

(30) Foreign Application Priority Data

Nov. 29, 2003 (KR) ..... 10-2003-0086015

(51) Int. Cl.[7] ..... F25D 17/04

(52) U.S. Cl. ..... 62/407; 62/419

(58) Field of Search ..... 62/407, 419, 446; 416/228, 203, 235

(56) References Cited

U.S. PATENT DOCUMENTS 5,326,225 A * 7/1994 Gallivan et al. ..... 416/719
5,536,140 A * 7/1996 Wagner et al. ..... 415/119
6,027,307 A * 2/2000 Cho et al. ..... 415/173.5
6,584,799 B2 * 7/2003 Jung et al. ..... 62/419

FOREIGN PATENT DOCUMENTS

JP 401325398 A * 12/1998

* cited by examiner

*Primary Examiner*—Melvin Jones
(74) *Attorney, Agent, or Firm*—Birch, Stewart, Kolasch & Birch, LLP

(57) ABSTRACT

A blowing fan includes: a hub connected to a rotational shaft of a motor and receiving a driving force of the motor; and a plurality of blades connected at equal intervals in a circumferential direction of the hub and generating a blowing force, in which a connection between the blades and the hub has an area-reduced form in order to reduce a rigidity of the connection portion. The rigidity between a hub where a rotational shaft is fixed and a blade is weakened to lower a torsional resonant frequency of the rotational shaft. Thus, a noise of a refrigerator is considerably reduced.

12 Claims, 6 Drawing Sheets

BLOWING FAN AND REFRIGERATOR HAVING THE SAME

This Nonprovisional application claims priority under 35 U.S.C. § 119(a) on Patent Application No(s). 10-2003-0086015 filed in Korea on Nov. 29, 2003, the entire contents of which are hereby incorporated by reference.

BACKGROUND OF THE INVENTION

1. Field of the Invention

The present invention relates to a blowing fan and, more particularly, to a blowing fan for a refrigerator capable of reducing a resonance noise according to a torsional resonance generated in driving a fan and avoiding a resonant frequency by lowering a torsional resonant frequency of a rotational shaft connecting the fan and a motor.

2. Description of the Background Art

In general, a refrigerator is divided into a freezing chamber for keeping frozen food items and a refrigerating chamber for keeping refrigerating food items, and includes a refrigerating cycle for supplying cooling air to the freezing chamber and the refrigerating chamber.

FIG. 1 is a front view of a refrigerator in accordance with a refrigerator.

The conventional refrigerator includes a main body 104 having a predetermined space for storing food items and a door 102 mounted at its front side for opening and closing; a freezing chamber 106 formed at an upper portion of the main body 104 and storing frozen food items; a refrigerating chamber 110 sectioned from the freezing chamber 106 by a barrier 108, formed at a lower portion of the main body 104, and storing refrigerating food items; and a refrigerating cycle for supplying cooling air to the freezing chamber 106 and the refrigerating chamber 110.

At a rear side of the freezing chamber 106, there is provided a space partitioned by a shroud 112, in which a heat exchanger 114 provides cooling air through heat-exchanging with a refrigerant, a axial-flow fan 118 blows air cooled while passing the heat exchanger 114 to the freezing chamber 106 and the refrigerating chamber 110, and a motor 120 is connected to the axial-flow fan 118 by a rotational shaft 122 to rotate the axial-flow fan 118.

As shown in FIG. 2, the axial-flow fan 118 includes a hub 150 into which the rotational shaft 122 of the motor 120 is fixed so as to receive a rotational force of the motor 120, and a plurality of blades 152 arranged at predetermined intervals at an outer circumference of the hub 150 and generating a flowing force.

The blade 152 is extended in a curved-surface form from the outer circumference of the hub 150, and in general, five blades are provided.

The operation of the refrigerator constructed as described will now be described.

When the axial-flow fan 118 is rotated according to driving of the motor 120, cooling air passes through the heat exchanger 114 and blows to the freezing chamber 106 and the refrigerating chamber 110, thereby performing a cooling operation. The cooling operation-completed air is sent back to the heat exchanger 114.

Since the refrigerator has a large capacity and its internal temperature is to be uniformly maintained to keep food items fresh for a long period, the method of discharging cooling air in several directions in the refrigerating chamber is adopted.

Accordingly, a cooling passage for guiding cooling air in each direction in the refrigerating chamber is long and complicate, generating much passage resistance to the flow of cooling air.

Thus, in order to smoothly and quickly circulate cooling air under such a high passage resistance, the axial-flow fan 118 needs to be rotated at a high speed. However, rotation of the axial-flow fan 118 at a high speed causes a torsional resonance phenomenon at the rotational shaft 122, which is a main reason of a noise of a refrigerator.

Thus, in order to solve such a noise problem, researches related to noise reduction are actively ongoing by using a shape designing of the rotational shaft 122 (notch, stepped shaft), a rotational inertia moment increase/decrease designing, or a coupling designing of the rotational shaft 122 and the axial-flow fan 118.

In this respect, however, in the conventional refrigerator, the design change in the rotational shaft 122 for the purpose of reducing the noise generated due to the torsional resonance phenomenon of the rotational shaft 122 necessarily accompanies a design change in parts coupled to the rotational shaft 122. Then, a unit cost would be increased, a productivity would be degraded, and a quality management wouldn't be easy due to the design change in many parts.

SUMMARY OF THE INVENTION

Therefore, an object of the present invention is to provide a blowing fan designed to lower rigidity between a hub in which a rotational shaft is fixed and blades to reduce a torsional resonant frequency of the rotational shaft to thereby considerably reduce a noise of a refrigerator, and a refrigerator using the blowing fan.

To achieve these and other advantages and in accordance with the purpose of the present invention, as embodied and broadly described herein, there is provided a blowing fan including: a hub connected to a rotational shaft of a motor and receiving a driving force of the motor; and a plurality of blades connected at equal intervals in a circumferential direction of the hub and generating a blowing force, in which a connection between the blades and the hub has an area-reduced form in order to reduce a rigidity of the connection portion.

A slot is formed at the connection portion between the blade and the hub by removing a portion of the connection portion.

To achieve the above objects, there is also provided a refrigerator including: a main body; a freezing chamber formed at an upper portion of the main body; a refrigerating chamber formed at a lower portion of the main body; and a blowing fan disposed at a rear portion of the main body and blowing cooling air required for the freezing chamber and the refrigerating chamber, wherein the blowing fan includes: a hub connected to a rotational shaft of a motor and receiving a driving force of the motor; and a plurality of blades connected at equal intervals in a circumferential direction of the hub and generating a blowing force, in which a connection portion between the blades and the hub has an area-reduced form in order to reduce a rigidity of the connection portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings. A blowing fan for a refrigerator in accordance with a preferred embodiment of the present invention will now be described with reference to the accompanying drawings.

There can be several embodiments of the blowing fan for a refrigerator, of which most preferred one will now be described.

Figure 1:
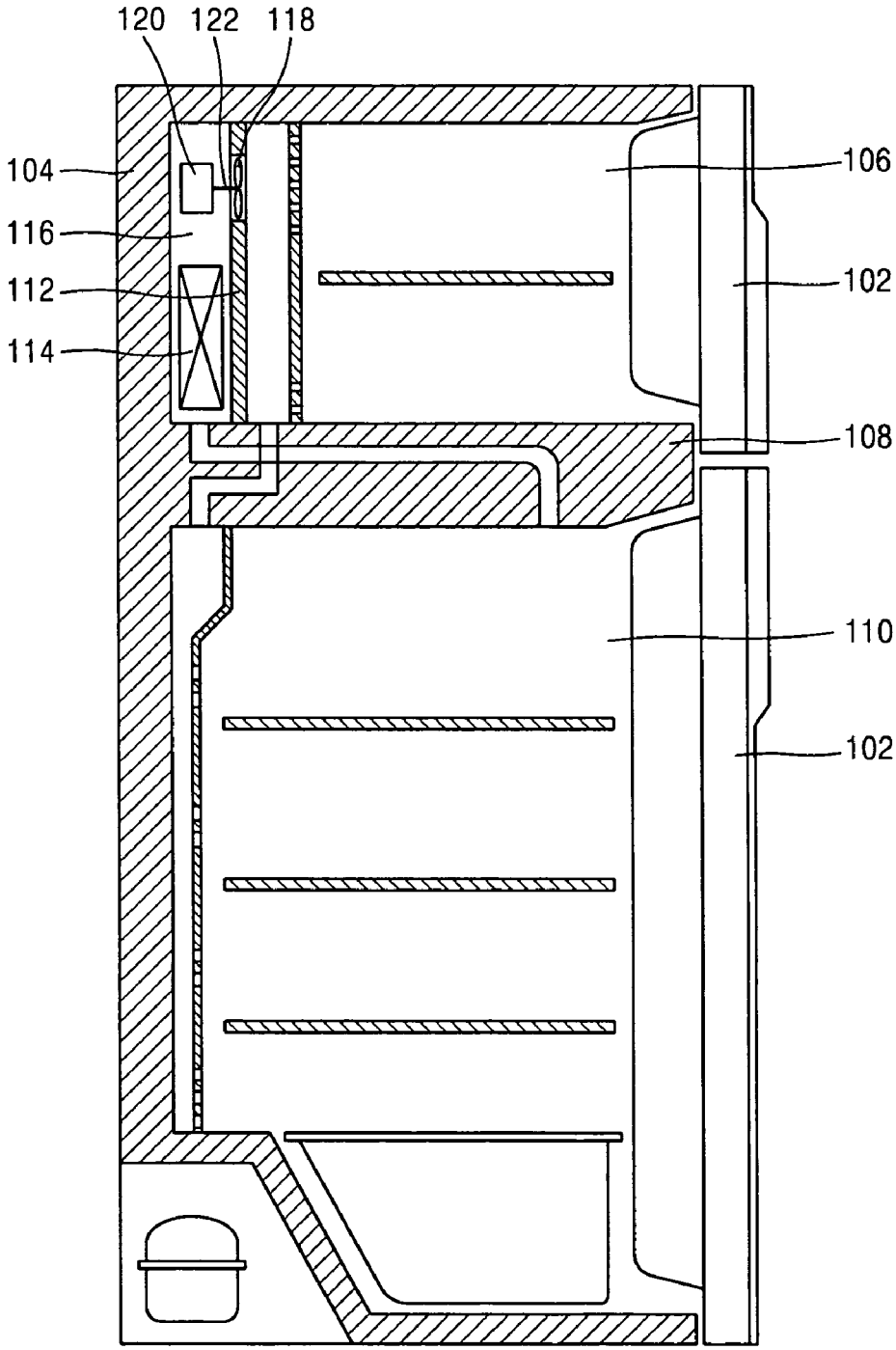
FIG. 1 CONVENTIONAL ART
FIG. 1 is a sectional view showing a refrigerator in accordance with a conventional art.
Figure 2:
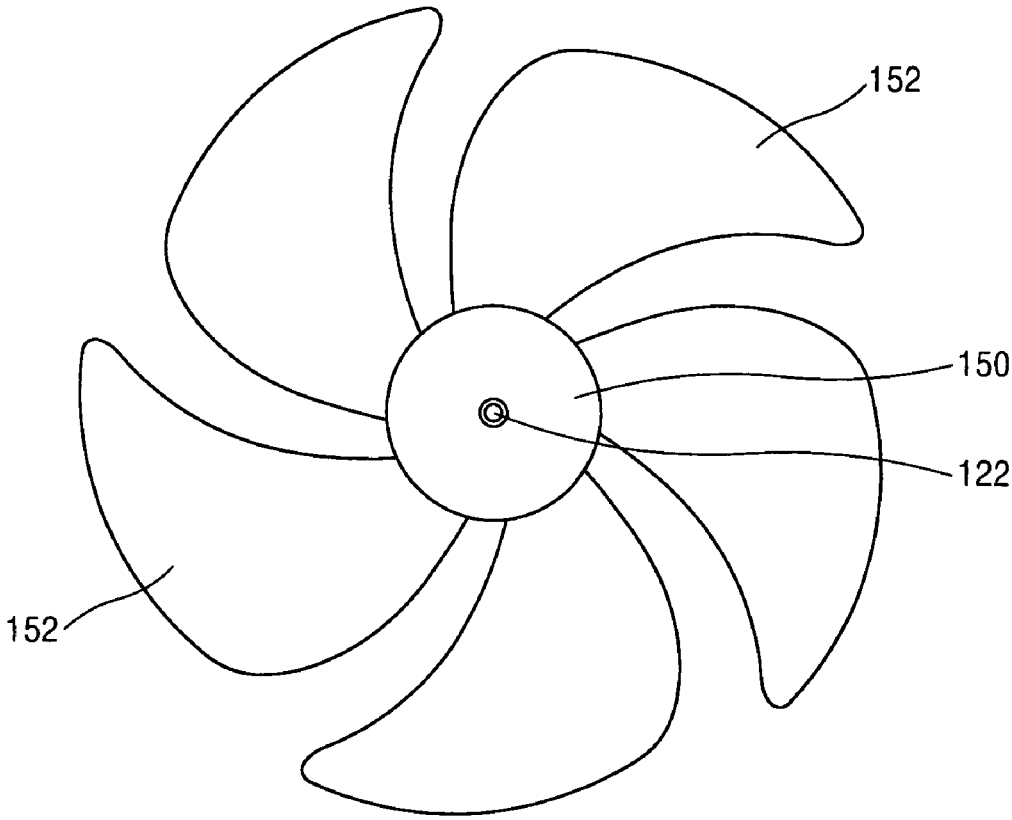
FIG. 2 CONVENTIONAL ART
FIG. 2 is a front view of an axial-flow fan for the refrigerator in accordance with the conventional art.
Figure 3:
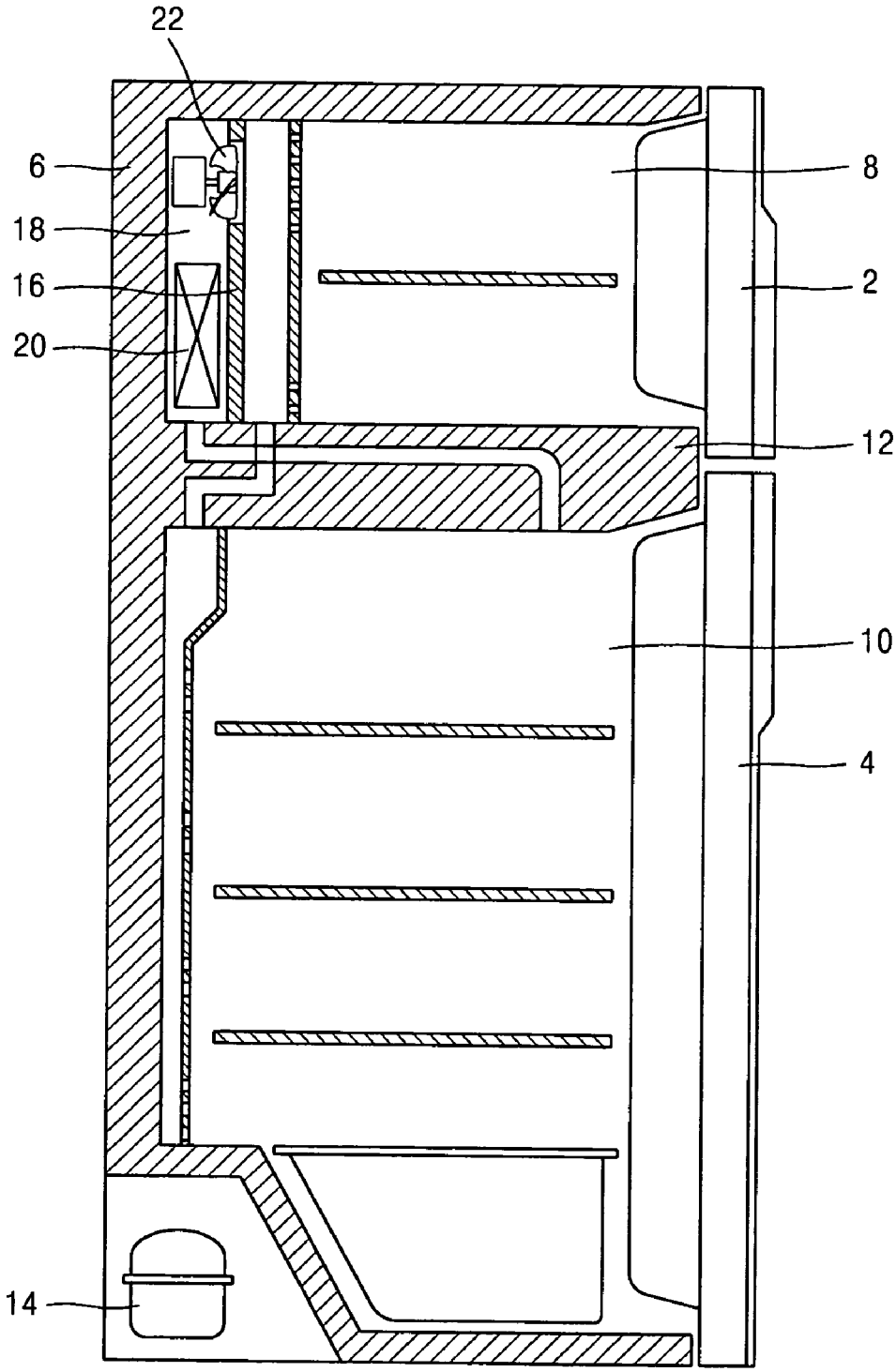
FIG. 3 is a sectional view of a refrigerator in accordance with the present invention.
Figure 4:
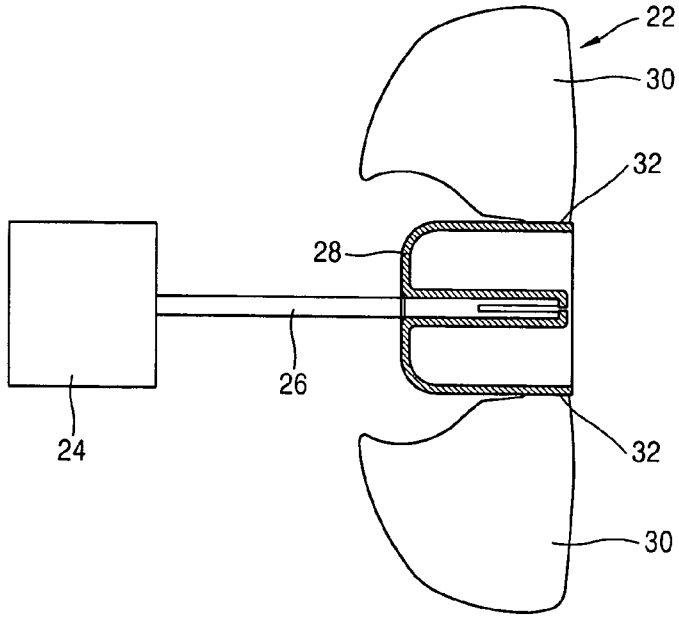
FIG. 4 is a side view of an axial-flow fan for a refrigerator in accordance with one embodiment of the present invention.
Figure 5:
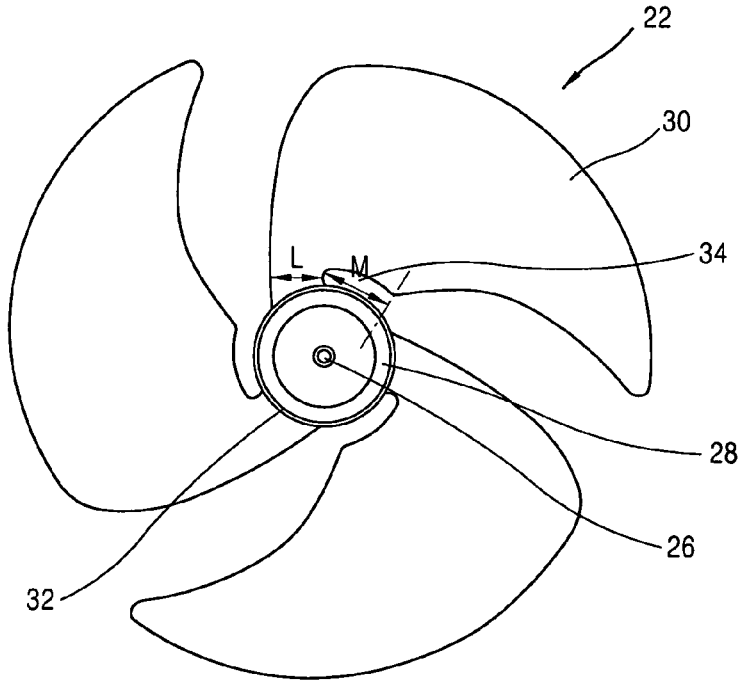
FIG. 5 is a front view of an axial-flow fan for a refrigerator in accordance with one embodiment of the present invention.

FIG. 3 is a sectional view of a refrigerator in accordance with the present invention, FIG. 4 is a side view of an axial-flow fan for a refrigerator in accordance with one embodiment of the present invention, and FIG. 5 is a front view of an axial-flow fan for a refrigerator in accordance with one embodiment of the present invention.

The refrigerator of the present invention includes a main body 6 having a predetermined space for storing food items and a freezing chamber door 2 and a refrigerating door 4 installed at its front side to be respectively opened and closed; a freezing chamber 8 formed at an upper portion of the main body 8 and storing refrigerating food items; a refrigerating chamber 10 partitioned by a barrier 12 from the freezing chamber 8, formed at a lower portion of the main body 6 and storing refrigerating food items; and a refrigerating cycle disposed at a rear side of the main body 6 and generating cooling air required for the freezing chamber 8 and the refrigerating chamber 10.

A compressor 14 for compressing a refrigerant is disposed at a rear side of the main body 6, and a space 18 is prepared by being partitioned by a shroud 16 at a rear side of the freezing chamber 8. In the space 16, there are installed a heat exchanger 20 to which a refrigerant is introduced after being compressed by the compressor 14 for a heat exchanging, and a blowing fan 22 for blowing air which has been cooled while passing the heat exchanger 20 into the freezing chamber 8 and the refrigerating chamber 10.

As shown in FIGS. 4 and 5, the blowing fan 22 includes a hub 28 connected to a motor 24 by a rotational shaft 26 and receiving a driving force of the motor 24, and a plurality of blades 30 arranged at equal intervals at an outer circumference of the hub 28 and generating a blowing force.

A connection portion 32 between the hub 28 and the blade 30 has a structure aimed for reducing a torsional rigidity in order to lower a torsional resonant frequency of the rotational shaft 26.

That is, if the rigidity of the connection portion 32 connecting the hub 28 and the blade 30 is strong, when the blowing fan 22 is driven, a torsional vibration is generated, causing a torsional resonance phenomenon at the rotational shaft 26.

Thus, by reducing the torsional rigidity of the connection portion 32 between the hub 28 and the blade 30, the torsional resonance phenomenon of the rotational shaft 26 is reduced, so that the torsional resonant frequency generated when the blowing fan 22 is driven can be lowered.

The torsional rigidity reduction structure of the connection portion 32 between the hub 28 and the blade 30 will now be described in detail.

As shown in FIG. 5, the rigidity of the connection portion between the hub 28 and the blade 30 is reduced by reducing an area of the connection portion 32 connected to the outer circumference of the hub 28.

In detail, the connection portion 32 is connected to the outer circumference of the hub 28 as long as the length (L), and a slot 34 as long as the length (M) is formed opened by removing one side of the connection portion between the hub 28 and the blade 30.

Accordingly, the connection rigidity of the blade 30 weakens, and when an air resistance is applied to the blade 30, the blade 30 itself absorbs the vibration to thereby reduce vibration transferred to the hub 28.

At this time, although the blade connection portion 32 has a reduced rigidity, it can generate a sufficient blowing force and has such a sufficient rigidity to be maintained and attached to the outer circumference of the hub 28.

Figure 6:
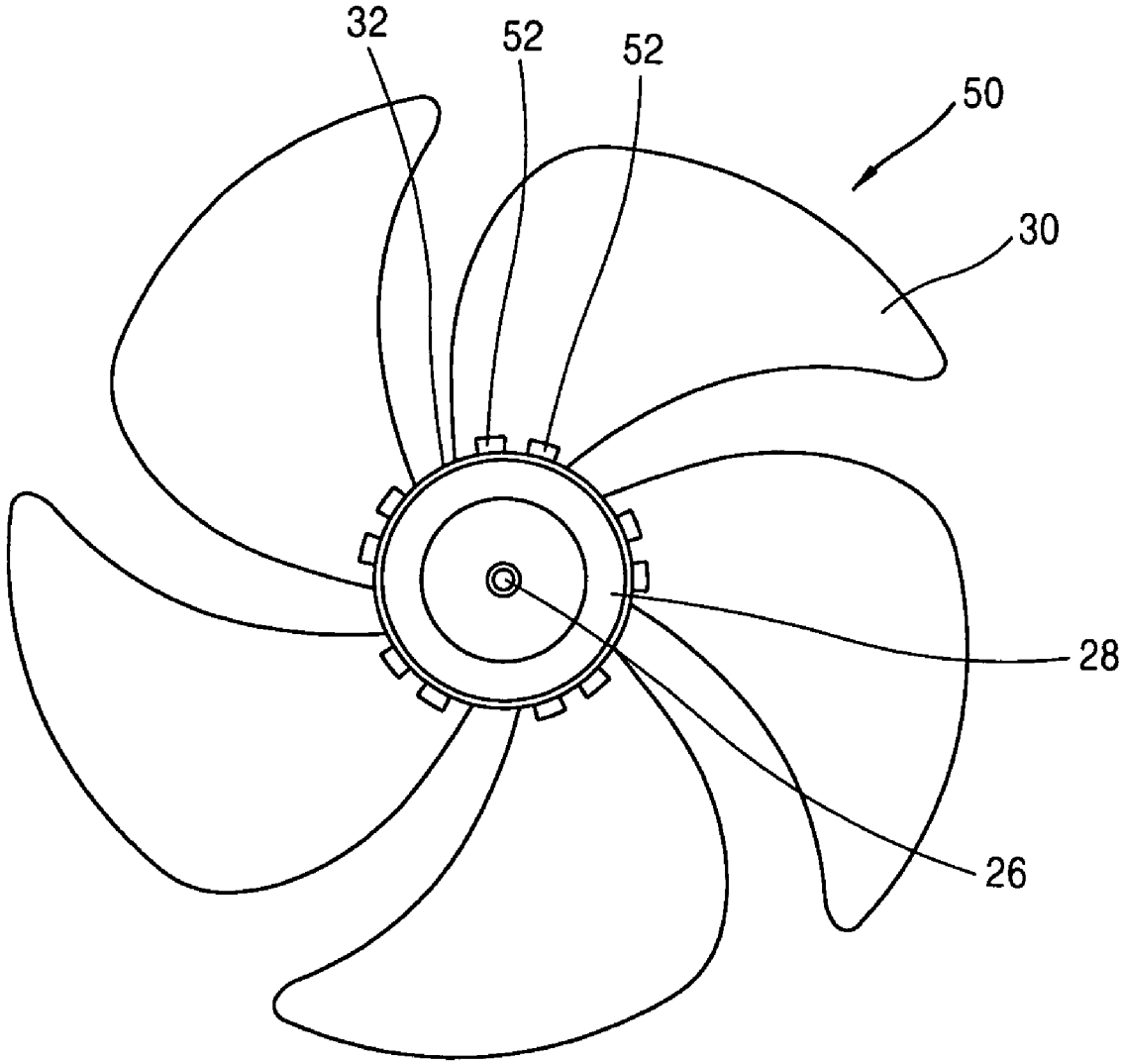
FIG. 6 is a front view of an axial-flow fan for a refrigerator in accordance with another embodiment of the present invention.

FIG. 6 is a front view of an axial-flow fan for a refrigerator in accordance with another embodiment of the present invention.

A blowing fan 50 in accordance with the second embodiment of the present invention has a structure to reduce a rigidity of the connection portion 32 where the blade 30 and the hub 28 are connected. A plurality of holes 52 are formed at regular intervals at the connection portion 32 to reduce a connection strength between the blade 30 and the hub 28.

One or more holes 52 are formed at the connection portion 32 between the hub 28 and the blade 30 to thereby reduce a connection area between the blade 30 and the hub 28.

The blowing fan for a refrigerator in accordance with the present invention is operated as follows.

When power is applied to the refrigerator, the heat exchanger 20 is operated and the flowing fan 22 is driven. Then, cooling air passes, which has passed through the heat exchanger 20, is supplied to the freezing chamber 8 and the refrigerating chamber 10 according to driving of the blowing fan 22, performing a cooling operation. The cooling operation-finished air is introduced into the heat exchanger 20.

At this time, by applying the blowing fan 22 adapted for reducing the torsional rigidity of the connection portion 32 between the hub 28 and the blade 30, the torsional resonance phenomenon of the rotational shaft 26 can be reduced to lower the torsional resonant frequency generated when the blowing fan 22 is driven.

Figure 7A:
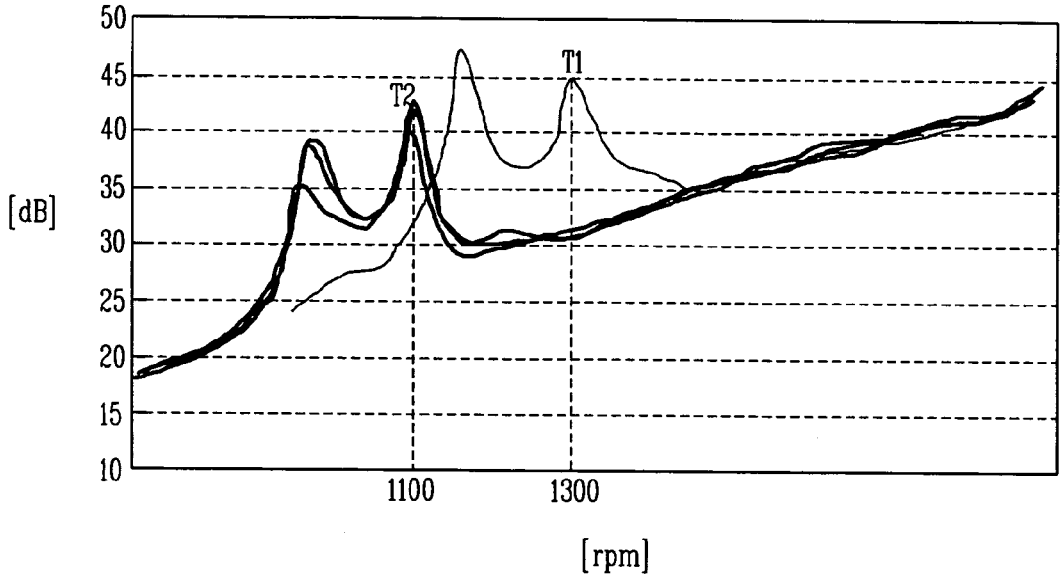
FIGS. 7A and 7B are graphs comparatively showing noise generated from the axial-flow fan of the present invention and that of the conventional art.
Figure 7B:
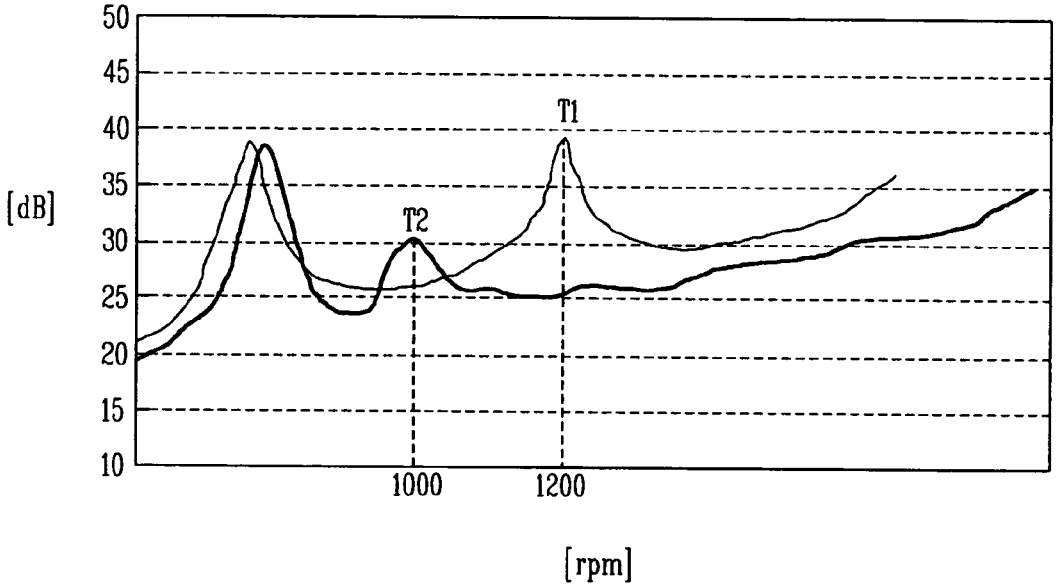

FIGS. 7A and 7B are graphs comparatively showing noise generated from the axial-flow fan of the present invention and that of the conventional art.

As shown in FIG. 7A, a comparison of each resonance rotational number generated from the blowing fan installed in the freezing chamber of the refrigerator shows that when the conventional axial flow fan is applied, a noise (T1) has a level of 45 dB(A) at about 1300 rpm, whereas when the blowing fan of the present invention is applied, a noise (T2) has a level of 43 dB(A) at about 1100 rpm. That is, application of the blowing fan according to the present invention can reduce the resonant rpm of more than about 200 rpm compared to the conventional axial flow fan.

And as shown in FIG. 7B, a comparison of each resonant rpm generated from the blowing fan installed in a mechanic chamber of the refrigerator shows that when the conventional axial flow fan is applied, a noise (T1) has a level of about 39 dB(A) at about 1200 rpm, whereas when the blowing fan of the present invention is applied, a noise (T2) has a level of 30 dB(A) at about 1000 rpm. That is, application of the blowing fan of the present invention can reduce the resonant rpm of more than about 200 rpm compared to the conventional axial flow fan.

As so far described, the blowing fan in accordance with the present invention has the following advantages.

That is, for example, since the slot is formed at the connection portion between the blade and the hub to lower the connection rigidity, when an air resistance is generated at the blade, the blade itself is elastically deformed to absorb the vibration, reducing the vibration transferred from the blade to the hub. Accordingly, a torsional resonance of the rotational shaft connected to the motor is lowered, so vibration generated from the blowing fan 22 can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A blowing fan comprising:

a hub connected to a rotational shaft of a motor and receiving a driving force of the motor; and a plurality of blades connected at equal intervals in a circumferential direction of the hub and generating a blowing force, wherein a connection portion between the blades and the hub has an area-reduced form in order to reduce a rigidity of the connection portion.

2. The blowing fan of claim 1, wherein a slot is formed at the connection portion between the blade and the hub by removing a portion of the connection portion.

3. The blowing fan of claim 2, wherein the slot is formed by removing a portion of the blade connected to the hub.

4. The blowing fan of claim 1, wherein a plurality of holes are formed at predetermined intervals at the connection portion between the blade and the hub.

5. The blowing fan of claim 4, wherein the holes are formed at predetermined intervals at the connection portion of the blade connected to the hub.

6. A refrigerator comprising:

a main body;

a freezing chamber formed at an upper portion of the main body;

a refrigerating chamber formed at a lower portion of the main body; and a blowing fan disposed at a rear portion of the main body and blowing cooling air required for the freezing chamber and the refrigerating chamber, wherein the blowing fan comprises:

a hub connected to a rotational shaft of a motor and receiving a driving force of the motor; and a plurality of blades connected at equal intervals in a circumferential direction of the hub and generating a blowing force, wherein a connection portion between the blades and the hub has an area-reduced form in order to reduce a rigidity of the connection portion.

7. The refrigerator of claim 6, wherein a slot is formed at the connection portion between the blade and the hub by removing a portion of the connection portion.

8. The refrigerator of claim 7, wherein the slot is formed by removing a portion of the blade connected to the hub.

9. The refrigerator of claim 6, wherein a plurality of holes are formed at predetermined intervals at the connection portion between the blade and the hub.

10. The refrigerator of claim 9, wherein the holes are formed at predetermined intervals at the connection portion of the blade connected to the hub.

11. The blowing fan of claim 1, wherein at least a hole is formed at the connection portion between the blade and the hub.

12. The refrigerator of claim 6, wherein at least a hole is formed at the connection portion between the blade and the hub.

* * * * *